US008092875B2

(12) United States Patent
Watanabe

(10) Patent No.: US 8,092,875 B2
(45) Date of Patent: Jan. 10, 2012

(54) COMPOSITE LUMINOUS VESSELS

(75) Inventor: Keiichiro Watanabe, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 938 days.

(21) Appl. No.: 12/061,073

(22) Filed: Apr. 2, 2008

(65) Prior Publication Data

US 2008/0280079 A1 Nov. 13, 2008

Related U.S. Application Data

(60) Provisional application No. 60/926,004, filed on Apr. 24, 2007.

(30) Foreign Application Priority Data

Apr. 3, 2007 (JP) ..... P2007-097204
Dec. 17, 2007 (JP) ..... P2007-324492

(51) Int. Cl.
*H01J 61/30* (2006.01)
*H01J 7/30* (2006.01)

(52) U.S. Cl. ..... 428/34.4; 445/22

(58) Field of Classification Search ..... 428/34.4; 313/623, 625, 111, 624; 362/362, 363
See application file for complete search history.

(56) References Cited

U.S. PATENT DOCUMENTS

| | | | | |
|---|---|---|---|---|
| 3,026,210 | A | 3/1962 | Coble | |
| 3,424,568 | A | 1/1969 | Martin et al. | |
| 4,174,487 | A * | 11/1979 | Peeters | 313/113 |
| 5,426,343 | A | 6/1995 | Rhodes et al. | |
| 5,549,746 | A | 8/1996 | Scott et al. | |
| 5,727,975 | A | 3/1998 | Wei et al. | |
| 6,126,889 | A | 10/2000 | Scott et al. | |
| 6,274,982 | B1 | 8/2001 | Scott et al. | |
| 6,447,937 | B1 * | 9/2002 | Murakawa et al. | 428/696 |
| 2003/0052605 | A1 | 3/2003 | Hecker et al. | |
| 2004/0185741 | A1 | 9/2004 | Hecker et al. | |
| 2005/0264150 | A1 | 12/2005 | Sawada | |
| 2006/0022596 | A1 | 2/2006 | Watanabe et al. | |
| 2006/0279218 | A1 * | 12/2006 | Uemura et al. | 313/636 |
| 2008/0203921 | A1 | 8/2008 | Brock et al. | |

FOREIGN PATENT DOCUMENTS

| | | | |
|---|---|---|---|
| EP | 1 755 147 | A1 | 2/2007 |
| JP | 01-182801 | | 7/1989 |
| JP | 02-064603 | | 3/1990 |
| JP | 07-050151 | | 2/1995 |
| JP | 8-501270 | | 2/1996 |
| JP | 08-138628 | | 5/1996 |
| JP | 2007-081131 | | 3/2007 |
| WO | 02/47102 | A2 | 6/2002 |
| WO | 2005/122214 | | 12/2005 |
| WO | 2008/105995 | A1 | 9/2008 |

* cited by examiner

*Primary Examiner* — Rena Dye
*Assistant Examiner* — Yan Lan
(74) *Attorney, Agent, or Firm* — Burr & Brown

(57) ABSTRACT

A composite luminous vessel container 3 has a hollow and polycrystalline alumina capillary 1 and one or more transparent disk(s) 2 of monocrystalline alumina. The polycrystalline alumina luminous container member 3 functions as a luminous part for a high intensity discharge lamp. Light is emitted from the inside of the polycrystalline alumina luminous member 3 and radiated through the transparent monocrystalline alumina disk to the outside. The light emitted through the transparent window has a low loss due to the scattering so that the lamp efficiency can be improved. In the case of the light emitted through the transparent monocrystalline alumina, the size of the light source is substantially equal to the distance between the electrodes, so that the light source can be utilized as a point light source. The light emitted from the point light source can be subjected to optical control by combination with reflectors or lenses.

15 Claims, 12 Drawing Sheets

COMPOSITE LUMINOUS VESSELS

FIELD OF THE INVENTION

The present invention relates to a polycrystalline alumina luminous vessel container in which a single-crystal transparent alumina disk is fitted.

BACKGROUND OF THE INVENTION

Single-crystal alumina (sapphire), which is transparent and excellent in heat resistance, wear resistance and corrosion resistance, has an excellent property in which it can be used even in a severer environment where metallic material or organic material is not usable. However, the single-crystal alumina can be formed into only a material of simple shape such as sheet or bar, since a process for melting alumina at a high temperature of a melting point (2050° C.) or higher in a crucible and doping and pulling a seed crystal to thereby grow the crystal (CZ process) or for depositing alumina powder in a melt state over a seed crystal to thereby grow the crystal (Verneuil Process) is adapted for production of the single-crystal alumina.

Further, sapphire is limited in available areas, since it is basically a hard and brittle material, and thus difficult to machine from the material.

On the other hand, polycrystalline alumina (PCA) is extensively used as a sintered body almost free from residual pores by baking a compact composed of alumina fine powder at a temperature lower than the melting point. Since the alumina fine powder can be shaped by use of various molding methods with high shape flexibility, alumina sintered bodies in various shapes are produced and industrially used.

Although the polycrystalline alumina was limited in uses to simple wear resisting and heat resisting members since it was basically impenetrable to light, Coble of US succeeded in development of a translucent polycrystalline alumina sintered body by sintering a high-purity alumina raw material with minimized impurities while adding a grain growth inhibitor, to allow the use to a luminous vessel for general lighting high-pressure sodium lamp or metal halide lamp (U.S. Pat. No. 3,026,210).

If a transparent alumina material further improved in translucency can be developed, improvement in luminous efficiency by reduction in loss of light by scattering and extension of the usable range not only as general lighting but also as point light source can be attained. From this point of view, in Japanese Patent Publication No. 07-165485A, a method for attaining both shape flexibility and transparency of polycrystalline alumina by converting a polycrystalline alumina sintered body to a single crystal body by contact with single-crystal alumina to thereby form a transparent body is proposed.

In Japanese Patent Publication No. 2001-519969A and Japanese Patent Publication No. 2003-157798A, it is proposed to produce a metal halide luminous vessel by joining a polycrystalline alumina sintered body to a single-crystal alumina vessel.

In Japanese Patent Publication No. H2-64603A, an invention of shrink-fitting a sapphire disk to the inside of a polycrystalline alumina vessel to be used as an observation window is disclosed.

In the method of Japanese Patent Publication No. H07-165485A, it is difficult to control the growing direction of crystals in the whole member to an optional direction, although the polycrystalline alumina can be partially converted to single crystals, and this method is hardly applicable to a complicated shape.

In the metal halide luminous vessel with polycrystalline alumina members shrink-fitted to both ends of a sapphire vessel, which is proposed in Japanese Patent Publication No. 2001-519969A and Japanese Patent Publication No. 2003-157798A, the sapphire vessel is difficult to produce and also high in cost, and straight traveling of light is disturbed by surface irregularities on the vessel surface characteristic to a crystal growing plane caused during crystal growth. Therefore, machining may be needed to smoothly finish the irregular surface, and in such case, the cost is further increased.

A light guide member including the sapphire disk shrink-fitted to the polycrystalline alumina vessel, which is disclosed in Japanese Patent Publication No. H2-64603A, is used for observing the internal state through the transparent sapphire window, and not aimed at application to a high-luminance discharge lamp luminous vessel, and no technical disclosure for developing airtightness is shown therein.

SUMMARY OF THE INVENTION

An object of the present invention is thus to provide a reliable and inexpensive high-luminance discharge lamp luminous vessel provided with a transparent window part.

The present invention provides a composite luminous vessel container comprising:

a luminous vessel member comprising polycrystalline alumina; and one or more transparent disks comprising single-crystal alumina;

wherein the transparent disk is directly fitted and incorporated into a circular opening part of the luminous vessel member so as to develop airtightness.

The polycrystalline alumina and single-crystal alumina which are components of the present invention are chemically composed of the same material, and stably used even at a high temperature as in a high-luminance discharge lamp without mutual reaction. Even if they are used as members which are stressed by a temperature difference, the difference in thermal expansion coefficient between the polycrystalline alumina and the single-crystal alumina is extremely small, with the thermal expansion coefficient of the polycrystalline alumina being a weighted average of thermal expansion coefficient of each crystal axis of the single-crystal alumina, and the thermal stress caused at an interface between the both is thus also minimized.

By limiting the shape of the single-crystal transparent alumina plate to a disk-like shape, the whole luminous vessel container can be uniformly thermally stressed without concentration of stress to a boundary between the single-crystal transparent alumina plate and a polycrystalline alumina portion. Therefore, high reliability can be ensured.

Light generated by electric discharge between electrodes can be released through a transparent window with minimized loss due to scattering or the like. Therefore, the lamp efficiency is improved. In a high-luminance discharge lamp using a luminous vessel composed of translucent alumina, the loss of the light generated by electric discharge between electrodes due to scattering was unavoidable since the light is not directly released but scattered within the luminous vessel prior to release to the outside.

In the high-luminance discharge lamp using the luminous vessel composed of translucent alumina, since the light generated by electric discharge between electrodes was scattered within the luminous vessel prior to release to the outside, the size of luminous vessel was constrained by the size of light source, resulting in formation of not a point light source but a diffuse light source. In the diffuse light source, control of light by combination with a reflector or lens is limited, so that the application to an optical device such as an automotive headlight or a projector is difficult, and the use thereof was thus limited to general lighting.

In the present invention, since the light generated by electric discharge between electrodes is released through the single-crystal alumina transparent window, the light emitted from a light emitting part is linearly released as it is, and can be treated substantially as a point light source when the discharge distance is small. The light emitted from the point light source can be subjected to optical control such as conversion to parallel lights or spot-like concentration by combination with various reflectors or lenses.

DETAILED DESCRIPTION OF THE INVENTION

Figure 1:
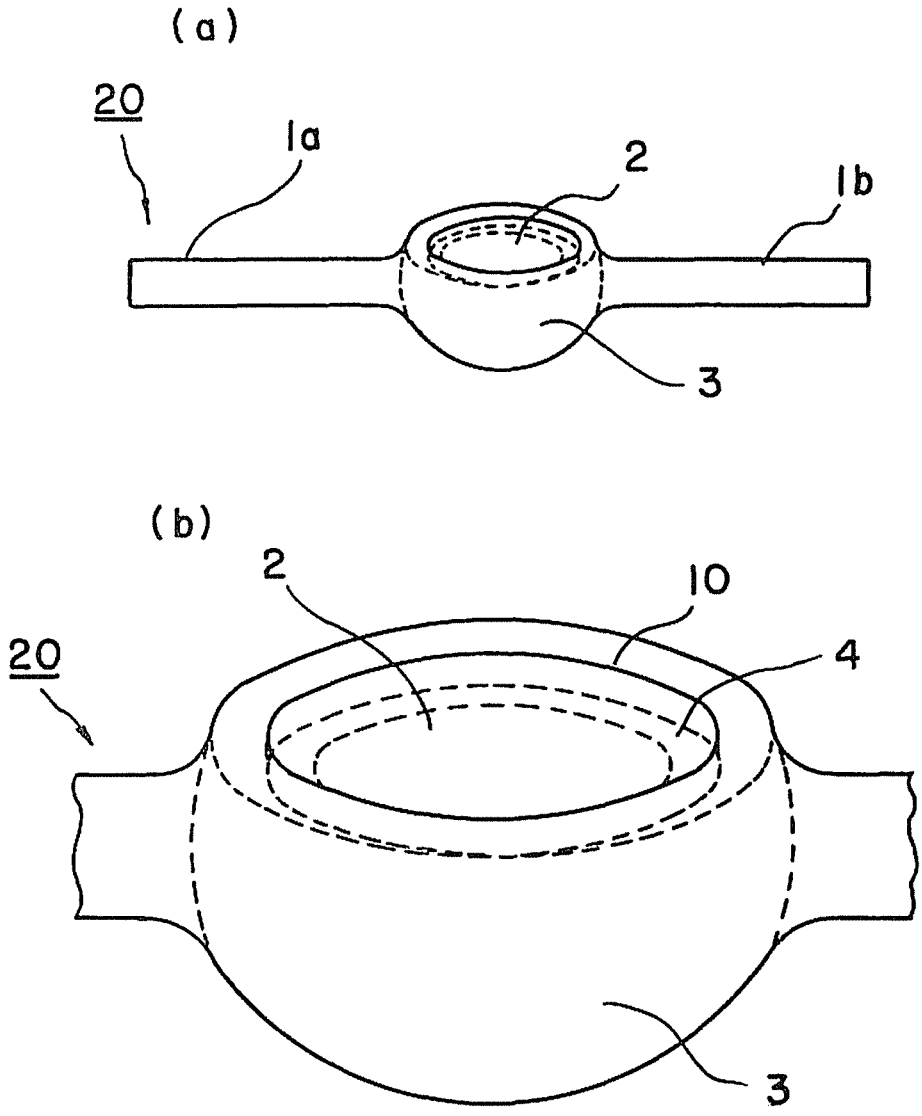
FIGS. 1(*a*) and 1(*b*) illustrate a composite luminous vessel container 20 of the present invention, wherein FIG. 1(*a*) is a perspective view thereof, and FIG. 1(*b*) is an enlarged perspective view of a polycrystalline alumina luminous vessel part thereof.

In a polycrystalline alumina luminous vessel member, a fitting force that will develop sufficient airtightness to a single-crystal transparent alumina disk can be ensured by setting its thickness to 0.3 mm or more. In the polycrystalline alumina luminous vessel member, thermal stress due to a temperature difference resulting from differential thickness can be minimized by setting its thickness to 3 mm or less. In a translucent polycrystalline alumina luminous vessel member, translucency in use for a high-luminance discharge lamp luminous vessel or the like can be also ensured by setting its thickness to 3 mm or less.

Further, the strength dispersion of the polycrystalline alumina luminous vessel member can be minimized to improve the reliability by setting its average crystal grain size to 40 μm or less.

In a first preferred embodiment, one single-crystal transparent alumina disk 1 is integrally fitted and fixed to a circular opening part without using a bonding material so as to develop airtightness by sintering differential shrinkage. Hollow capillaries composed of the same polycrystalline alumina as the luminous vessel member material are each disposed axially symmetrically outside the luminous vessel member so as to be parallel to the single-crystal transparent alumina disk. A gap intervened between two electrode tips is ensured near a virtual center of gravity of the luminous vessel member by charging a luminous material and a gas into the luminous vessel member by using through-holes provided within the capillaries and inserting and hermetically fixing electrode bars, so that the electrode tips are not contacted with each other. The luminous vessel member can be made to function as a high-luminance discharge lamp luminous vessel by generating electric discharge within the gap.

The polycrystalline alumina luminous vessel member can be formed in a substantially spherical hollowed shape. Assuming, for example, a substantially spherical virtual shape for the luminous vessel member, one circular opening part is formed in the luminous vessel member so as to have a shape obtained by cutting and removing a part of the virtual shape along a plane.

In a second preferred embodiment, the polycrystalline alumina luminous vessel member is formed in a cylindrical shape, and a total of two single-crystal transparent alumina disks are integrally fitted and fixed each to both opening the end parts of the member without using a bonding material so as to develop airtightness by sintering differential shrinkage. Hollow capillaries composed of the same polycrystalline alumina as the cylinder material are each disposed axially symmetrically outside the side circumferential surface of the cylinder so that the center axes thereof pass through a virtual center of gravity of the cylinder. A gap intervened between two electrode tips is ensured in the virtual center-of-gravity position within the cylinder, by charging a luminous material and a gas to the inside and further inserting and hermetically fixing electrode bars so that the electrode tips are not contacted with each other by using through-holes provided within the capillaries. Similarly to the first preferred embodiment, the luminous vessel member can be made to function as a high-luminance discharge lamp luminous vessel by generating electric discharge within the gap.

According to the structures as described above, the distance between a plasma emission part by electric discharge and the cylinder inside wall becomes isotropic since the gap between the electrode tips is matched with the center of gravity of the cylinder. Therefore, the temperature of the plasma emission part can be uniformly kept, and a stable lighting state can be thus maintained.

In a third preferred embodiment, the polycrystalline alumina luminous vessel member is basically formed of a regular triangle pole, and a total of two hollow capillaries composed of polycrystalline alumina are each disposed axially symmetrically on both end surfaces of the triangle pole so that the central axes pass through the virtual center of gravity of the triangle pole. A total of three single-crystal transparent alumina disks are each disposed in circular opening parts provided on the side circumferential surfaces of the triangle pole, the inside surface of each circular opening part of the polycrystalline alumina luminous vessel member being directly integrated with the side circumferential surface of each sapphire disk so as to develop airtightness by sintering.

According to such a structure, the opening area ratio of the single-crystal transparent alumina disk can be increased, compared with the structure having two single-crystal transparent alumina disks fitted to the side surfaces of the cylinder.

Since each capillary is provided so that the extension line of the central axis thereof passes through the virtual center of gravity of the triangle pole, a gap formed by two electrode tip parts at the virtual center of gravity of the triangle pole can be ensured, similarly to the first and second embodiments, by charging a luminous material and a gas and inserting and hermetically fixing electrode bars so that the electrode tips are not contacted with each other by using through-holes provided within the capillaries. The luminous vessel member can be made to function as a high-luminance discharge lamp luminous vessel.

Further, the distance between a plasma emission part by electric discharge and the inner surface wall of the triangle pole is isotropic since the gap between the electrode tips is matched with the center of gravity of the triangle pole. Therefore, the plasma temperature can be uniformly kept, and a stable lighting state can be thus easily maintained.

In a fourth preferred embodiment, the polycrystalline alumina luminous vessel member is basically formed of a cube (regular hexahedron), and a total of two hollow capillaries composed of polycrystalline alumina are each disposed axially symmetrically at two symmetric apexes which pass through a virtual center of gravity of the cube. A total of six single-crystal transparent alumina disks are each disposed in circular opening parts provided on the side circumferential surfaces of the cube, and the inside surface of each opening part of the polycrystalline alumina luminous vessel member is directly integrated with the side circumferential surface of each single-crystal transparent alumina disk so as to develop airtightness by sintering.

According to such a structure in which six single-crystal transparent alumina disks are fitted to the luminous vessel member, the opening area ratio of single-crystal transparent alumina disk in the composite luminous vessel container can be further increased, compared with the structure having two single-crystal transparent alumina disks fitted to the side surfaces of the cylinder or having three single-crystal transparent alumina disks fitted to the side surfaces of the triangle pole.

Since each capillary is provided so that the extension line of the central axis thereof passes through the virtual center of gravity of the cube, similarly to the first, second and third preferred embodiments, a gap formed by two electrode tips can be ensured at the virtual center of gravity of the cube, by charging a luminous material and a gas and further inserting and hermetically fixing electrode bars so that the electrode tips are not contacted with each other by using through-holes provided within the capillaries. The luminous vessel member can be made to function as a high-luminance discharge lamp luminous vessel.

Further, the distance between a plasma emission part in electric discharge and the inner surface wall of the cube is uniformed since the gap between the electrode tips is matched with the center of gravity of the cube. Therefore, the plasma temperature can be uniformed, and a stable lighting state can be thus easily maintained.

When an angle formed by an axis extending vertically to the surface of the single-crystal transparent alumina disk through the virtual center of gravity and a virtual line extending from the side circumferential surface of the single-crystal transparent alumina disk through the virtual center of gravity is smaller than 15°, the relative opening area of single-crystal transparent alumina disk is reduced, and a light quantity usable as point light source cannot be sufficiently ensured. Similarly, a light with an angle formed by the axis extending vertically to the surface of the single-crystal transparent alumina disk through the virtual center of gravity and the virtual line extending from the side circumferential surface of the single-crystal transparent alumina disk through the virtual center of gravity larger than 60° cannot be effectively used since it is totally reflected at the surface of the single-crystal transparent alumina disk. It is useless to fit a single-crystal transparent alumina disk having an extremely large opening area.

Fixation of the single-crystal transparent alumina disk is facilitated at the time of direct integration and fitting by sintering shrinkage by forming a stepped portion for positioning the single-crystal transparent alumina disk to the circular opening part of the polycrystalline alumina luminous vessel member.

When the thickness of the single-crystal transparent alumina disk is 0.3 mm or more, the alumina disk can resist stress in shrink fitting to the polycrystalline alumina luminous vessel member. When the thickness of the single crystal transparent alumina disk exceeds 3 mm, cracking may be caused on the polycrystalline alumina side at the time of shrink fitting due to excessively increased residual stress on the polycrystalline alumina side, and it becomes difficult to maintain the airtightness.

When the diameter of the single-crystal transparent alumina disk is less than 2 mm, the opening area is too small to sufficiently exhibit the effect of the present invention. Further, a fastening force cannot be ensured at the time of shrink fitting, and the airtightness is hardly developed. When the diameter of the single-crystal transparent alumina disk exceeds 50 mm, excessively increased residual stress on the polycrystalline alumina luminous vessel member side may cause cracking on the polycrystalline alumina luminous vessel member side, and it becomes difficult to maintain the airtightness.

When the surface roughness (Ra) in flat surface part of the single-crystal alumina disk is 0.01 μm or less, the scattering due to surface irregularities can be reduced to ensure the function as a transparent body.

When an angular part of the single-crystal transparent alumina disk, where the flat surface and side circumferential surface thereof mutually cross, takes an acute angle, chipping is caused during shrink fitting, and cracking progresses in the single-crystal transparent alumina disk, starting from this point, resulting in disturbance of the development of airtightness. Therefore, the angular part of the single-crystal transparent alumina disk, where the flat surface and the side circumferential surface thereof mutually cross, is rounded, whereby such chipping can be effectively prevented.

The C-axial direction of the single-crystal transparent alumina disk may be set to ±5° or less to the thickness direction thereof. According to this, the thermal expansion coefficient in a planar direction of the single-crystal transparent alumina disk becomes isotropic, and the stress generated in the fitting to the circular opening part of the polycrystalline alumina luminous vessel member can be also substantially isotropically uniformed to avoid concentration of stress.

The single-crystal transparent alumina disk may include a portion slightly differed in crystal axis which is called sub-grain. When shrink fitting is performed using such a single-crystal transparent alumina disk including the sub-grain, the single-crystal transparent alumina disk may be cracked after shrink fitting. Therefore, the single-crystal transparent alumina disk preferably includes no sub-grain.

Some preferred embodiments of the present invention will be further described in reference to the accompanying drawings.

Figure 2:
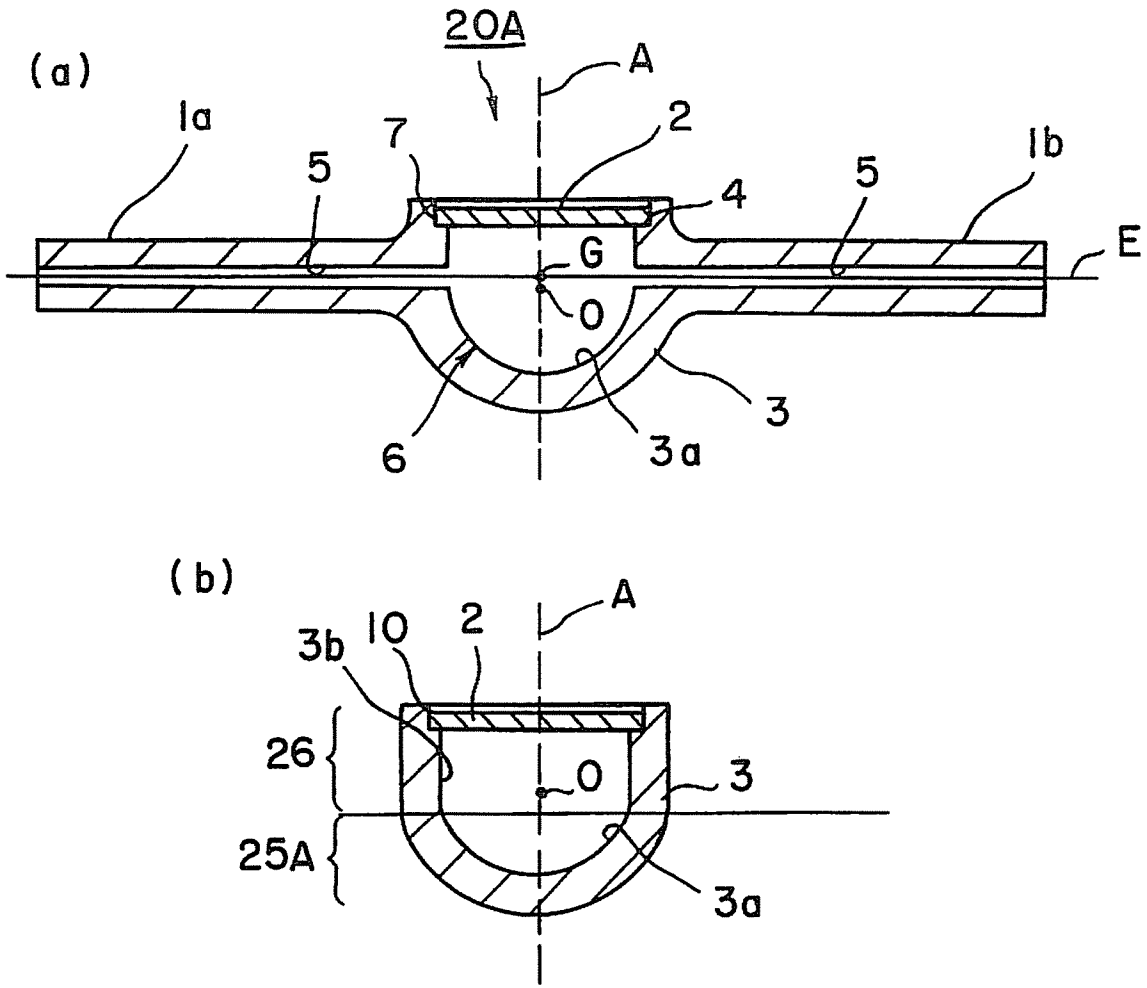
FIGS. 2(*a*) and 2(*b*) illustrate a composite luminous vessel container 20A having the appearance shown in FIG. 1(*a*), wherein FIG. 2(*a*) is a vertical sectional view thereof, and FIG. 2(*b*) is a cross sectional view thereof.

FIG. 1(*a*) is a perspective view of a composite luminous vessel container 20 of the present invention, and FIG. 1(*b*) is an enlarged perspective view of a polycrystalline alumina luminous vessel part thereof. FIGS. 2(*a*), 3(*a*), and 4(*a*) are vertical sectional views of composite luminous vessel containers having the appearance shown in FIG. 1, respectively. FIGS. 2(*b*), 3(*b*) and 4(*b*) are cross sectional views of the composite luminous vessel containers having the appearance shown in FIG. 1.

In the embodiment shown in FIG. 1, the composite luminous vessel container structure 20 comprises a hollow polycrystalline alumina luminous vessel member 3 and hollow capillaries 1*a* and 1*b* composed of polycrystalline alumina. The luminous vessel 3 has an outer shape formed by cutting one surface of a virtual substantial sphere along a plane. A total of two capillaries 1*a* and 1*b* are each disposed outside the side surface of the luminous vessel member so that the central axes thereof pass through a virtual center of gravity of the virtual sphere. One single-crystal transparent alumina disk 2 is fitted to a circular opening part 10 of the luminous vessel member 3 by use of a positioning stepped portion 4. A side circumferential surface 7 of the single-crystal transparent alumina disk 2 is directly integrated with the inside surface of the circular opening part so as to develop airtightness by sintering.

Figure 3:
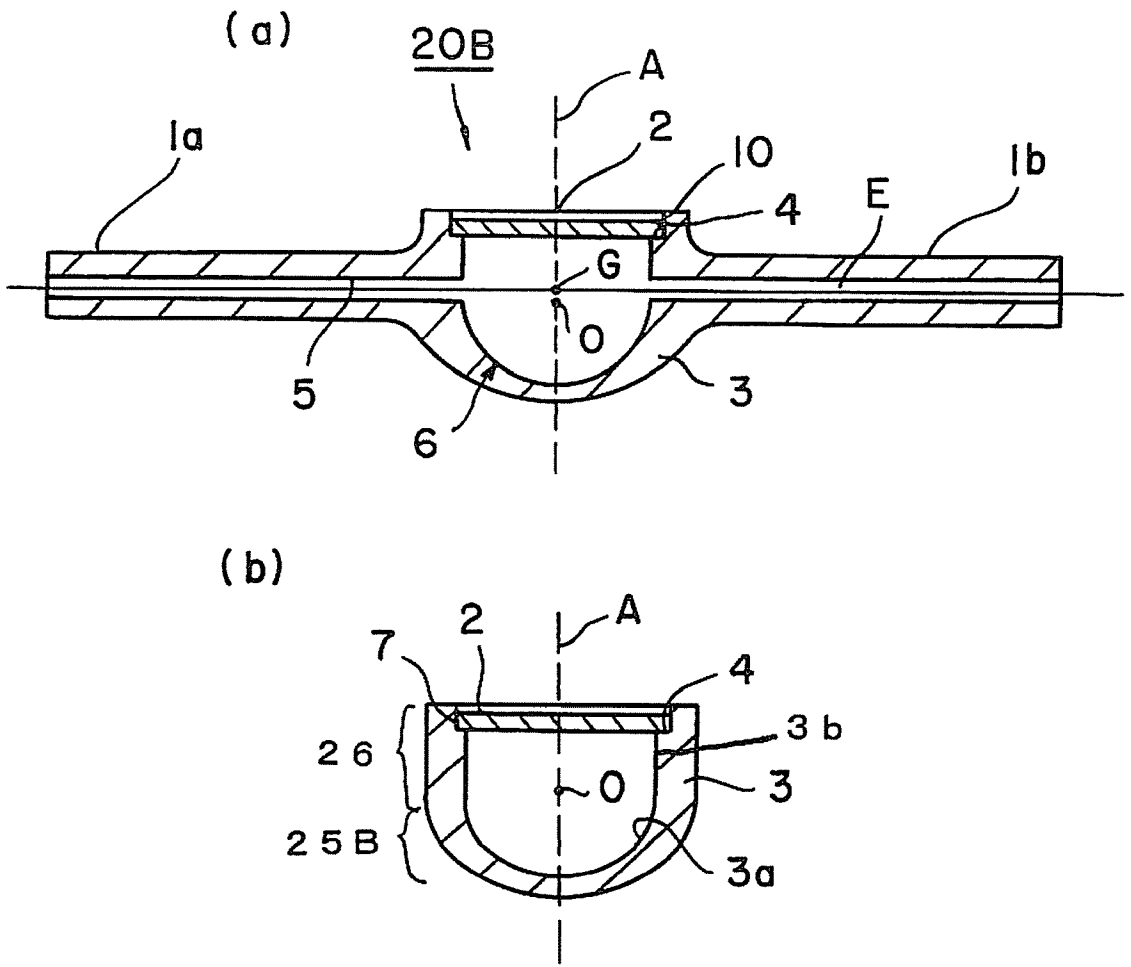
FIGS. 3(*a*) and 3(*b*) illustrate a composite luminous vessel container 20B having the appearance shown in FIG. 1(*a*), wherein FIG. 3(*a*) is a vertical sectional view thereof, and FIG. 3(*b*) is a cross sectional view thereof.
Figure 4:
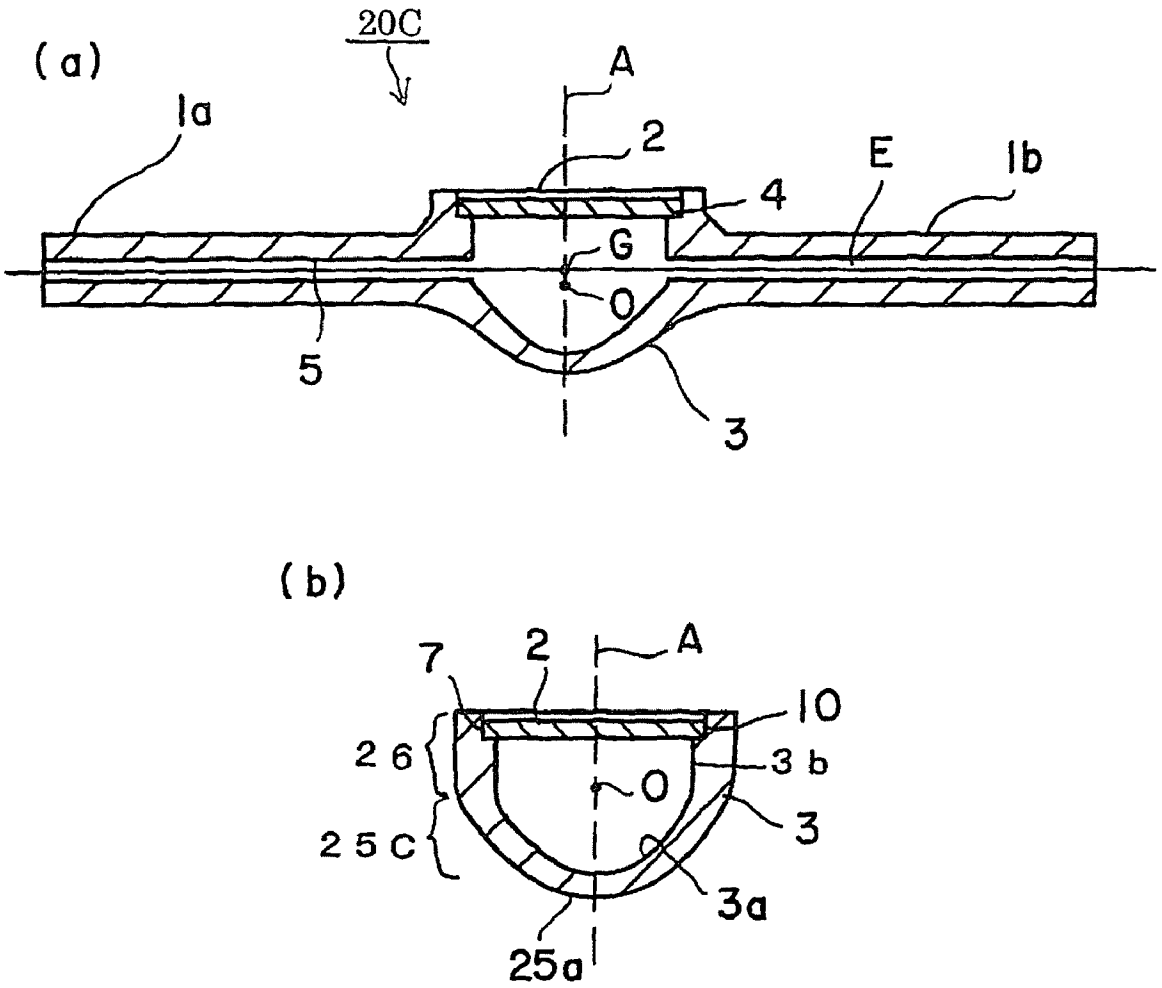
FIGS. 4(*a*) and 4(*b*) illustrate a composite luminous vessel container 20C having the appearance shown in FIG. 1(*a*), wherein FIG. 4(*a*) is a vertical sectional view thereof, and FIG. 4(*b*) is a cross sectional view thereof.

FIGS. 2 to 4 are sectional views of composite luminous vessel container structures 20A, 20B and 20C, respectively. The inside shape of the hollow alumina luminous vessel member 3 is formed of a curved surface rotationally symmetric around a virtual axis A vertically passing through the center of the circular opening part 10.

That is, in the embodiment shown in FIGS. 2(*a*) and (*b*), the luminous vessel member 3 includes a hemispherical bottom part 25A and a cylindrical part 26 extending upward therefrom. An inner surface 3*a* of the hemispherical bottom part 25A and an inner surface 3*b* of the cylindrical part 26 are rotationally symmetric to the virtual line A vertically passing through the center of the circular opening part. A central axis E of each capillary passes near a virtual center of gravity O of the luminous vessel member 3, and also passes on the virtual center of gravity G of the virtual sphere. A pair of capillaries is rotationally symmetric to the virtual center of gravity G of the virtual sphere.

In the embodiment shown in FIGS. 3(*a*) and (*b*), the luminous vessel member 3 includes a spheroidal bottom part 25B and a cylindrical part 26 extending upward therefrom. The inner surface 3*a* of the bottom part 25B and the inner surface 3*b* of the cylindrical part 26 are rotationally symmetric to the virtual line A vertically passing through the center of the circular opening part. The central axis E of each capillary passes near the virtual center O of gravity of the luminous vessel member 3, and passes on the virtual center G of gravity of the virtual sphere. A pair of capillaries is rotationally symmetric to the virtual center G of gravity of the virtual sphere.

In the embodiment shown in FIGS. 4(*a*) and (*b*), the luminous vessel member 3 includes a conical part 25B and a cylindrical part 26 extending upward therefrom. A tip 25*a* of the conical part 25B is curved in a spherical shape. The inner surface 3*a* of the conical part 25B and the inner surface 3*b* of the cylindrical part 26 are rotationally symmetric to the virtual line A vertically passing through the center of the circular opening part. The central axis E of each capillary passes near the virtual center O gravity of the luminous vessel member 3, and also passes on the virtual center G of gravity of the virtual sphere. A pair of capillaries is rotationally symmetric to the virtual center G of gravity of the virtual sphere.

In the embodiment shown in FIGS. 4(*a*) and (*b*), the luminous vessel member 3 includes a conical part 25C and a cylindrical part 26 extending upward therefrom. A tip 25*a* of the conical part 25B is curved in a spherical shape. The inner surface 3*a* of the conical part 25C and the inner surface 3*b* of the cylindrical part 26 are rotationally symmetric to the virtual line A vertically passing through the center of the circular opening part. The central axis E of each capillary passes near the virtual center O of gravity of the luminous vessel member 3, and also passes on the virtual center G of gravity of the virtual sphere. A pair of capillaries is rotationally symmetric to the virtual center G of gravity of the virtual sphere.

Figure 5:
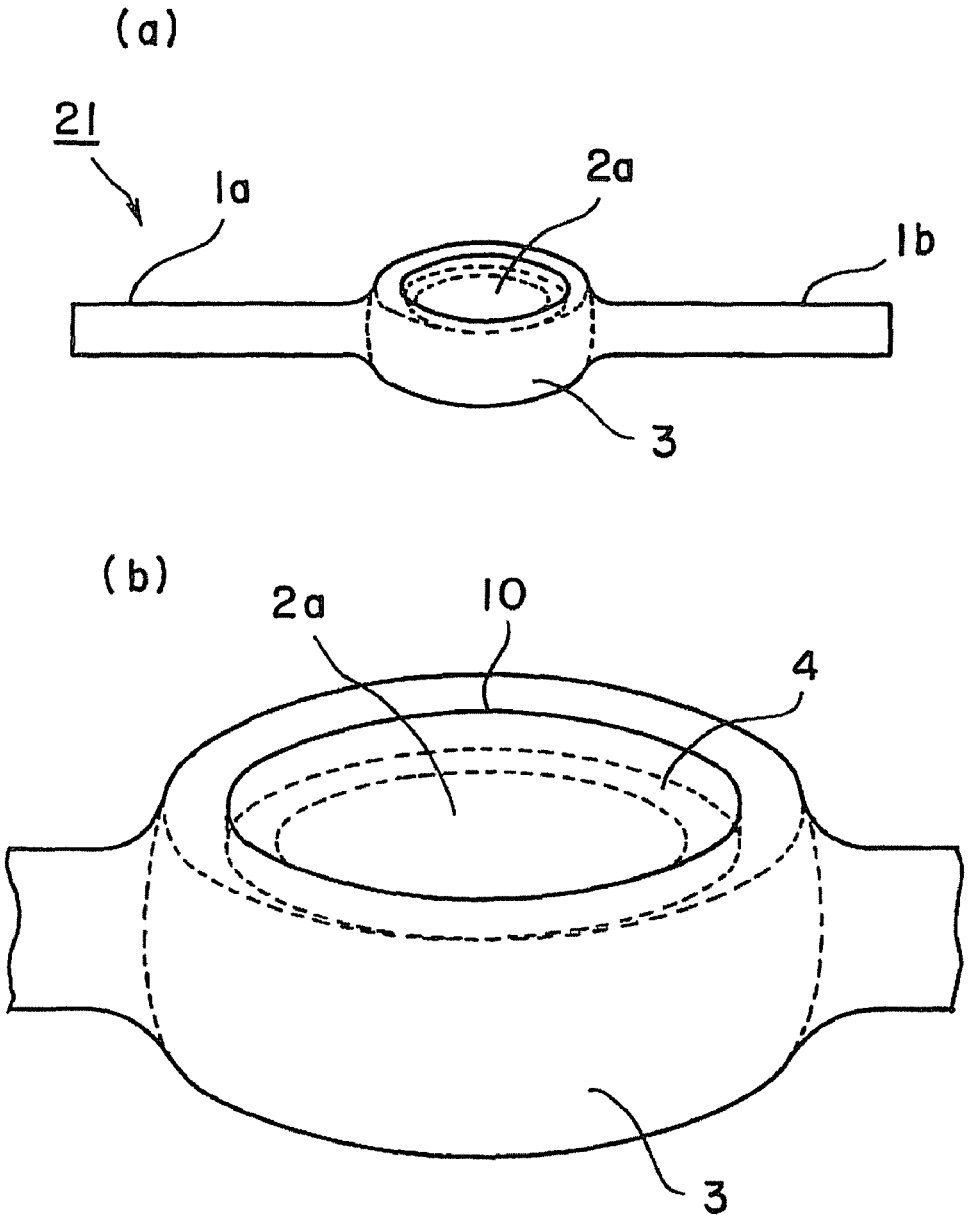
FIGS. 5(*a*) and 5(*b*) illustrate a structure 21, wherein FIG. 5(*a*) is a perspective view thereof, and FIG. 5(*b*) is an enlarged view of a cylindrical end portion in FIG. 5(*a*).

In the embodiment shown in FIG. 5, a composite luminous vessel container structure 21 comprises a cylindrical polycrystalline alumina luminous vessel member 3, and a total of two hollow capillaries 1*a* and 1*b* similarly composed of polycrystalline alumina. Each capillary is disposed axially symmetrically outside the side circumferential surface of the cylinder so that the central axis thereof passes through the virtual center of gravity of the cylinder. A total of two single-crystal transparent alumina disks 2*a* (and 2*b*, not shown: see, e.g., FIG. 6) are each fitted to both end opening parts of the cylinder by use of positioning stepped portions 4. The side circumferential surface of the single-crystal transparent alumina disk is directly integrated with the inner surface of the cylinder so as to develop airtightness by sintering.

Figure 6:
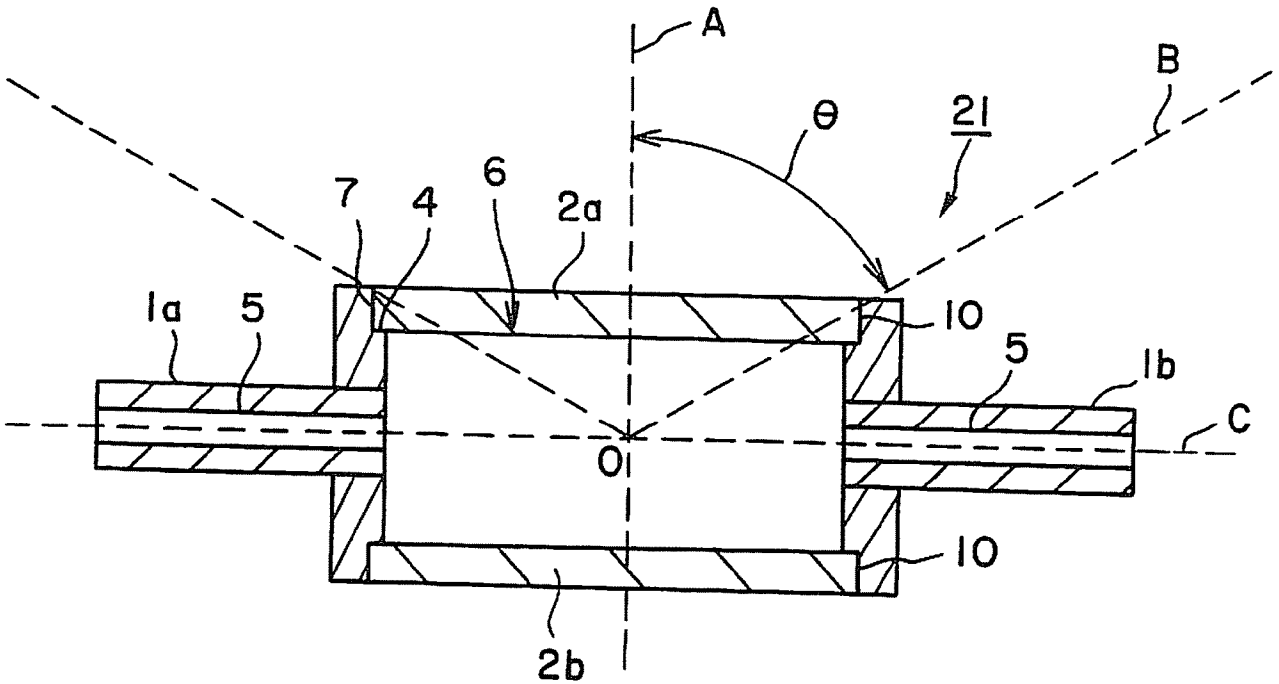
FIG. 6 is a sectional view of the structure 21.

FIG. 6 shows a vertical section of the composite luminous vessel container structure 21. In this figure, an angle θ is defined by an axis A extending vertically to the single-crystal transparent alumina disk through the virtual center O of gravity within the cylinder and a virtual line B extending from the side circumferential surface of the single-crystal transparent alumina disk to pass through the virtual center of gravity. When the angle is 15° or less, the ratio of diameter to height of the cylinder is as small as 0.26 or less: 1, and the opening part of the cylinder is considerably reduced. Therefore, the ratio of light usable as point light source reduces. Further, since the narrowed shape of the cylinder results in large variations of the distance between the plasma generated by discharge at the gap between electrodes at the central portion of the luminous vessel and the inner wall of the cylinder depending on the direction. It becomes thus difficult to stably maintain the electric discharge.

When the angle θ exceeds 60°, the ratio of diameter to height of the cylinder exceeds 1.17:1, and a large opening part can be ensured in the cylinder. However, the light emitted from the central portion of the luminous vessel and incident on the single-crystal transparent alumina disk is totally reflected within the luminous vessel at an incident angle of 60° or more without being radiated out of the luminous vessel. Further, since the flattened shape of the cylinder results in large variations of the distance between plasma generated by discharge at the gap between electrodes at the central portion of the luminous vessel and the inner wall of the cylinder depending on the direction. It becomes thus difficult to stably maintain the electric discharge.

Figure 7:
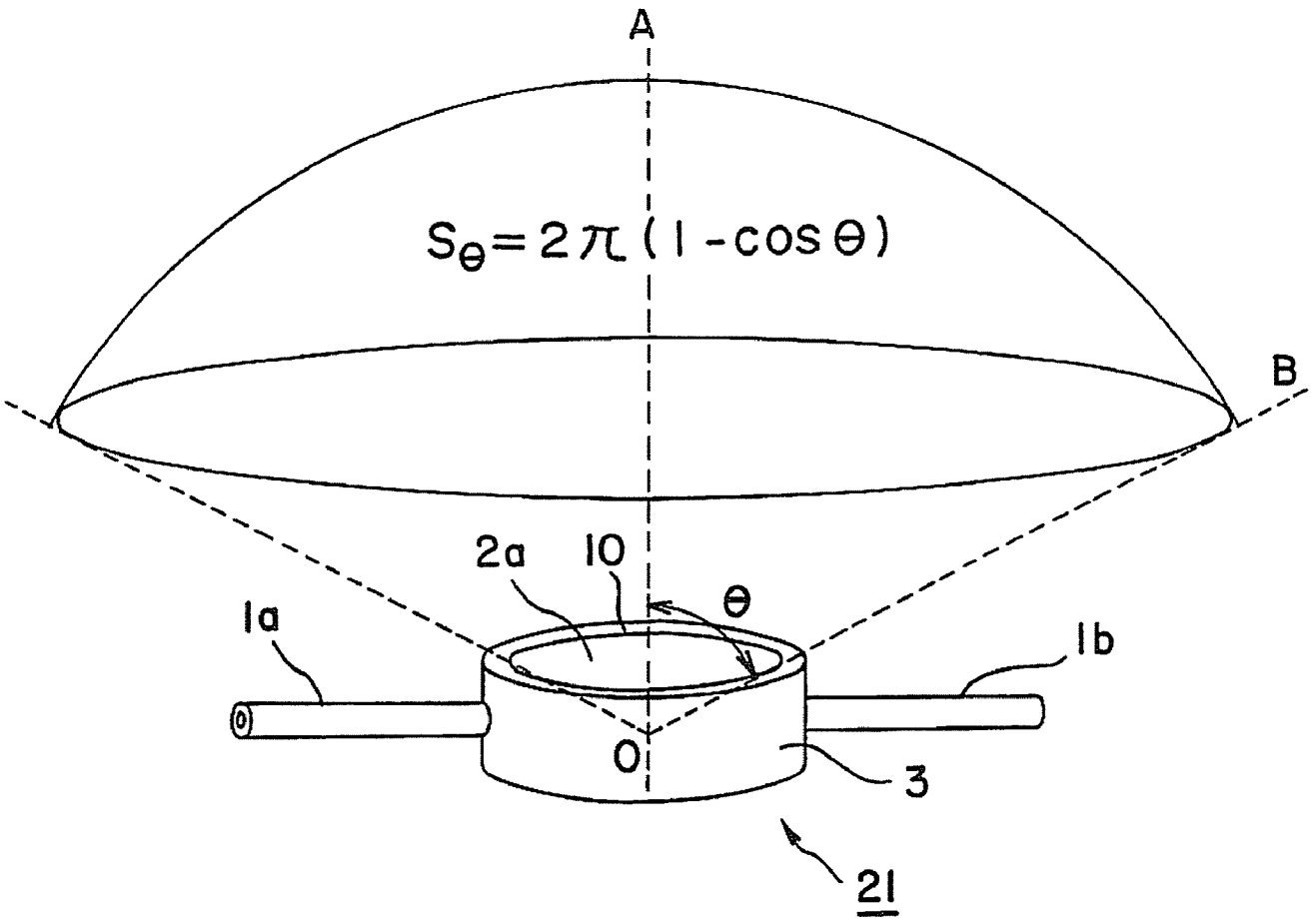
FIG. 7 is a perspective view of the structure 21, which shows a spread of light emitted from a virtual center of gravity.

FIG. 7 shows the area ratio (solid angle) of light released through the transparent single-crystal alumina disk to the whole light generated at the virtual center of gravity of the composite luminous vessel container.

Figure 8:
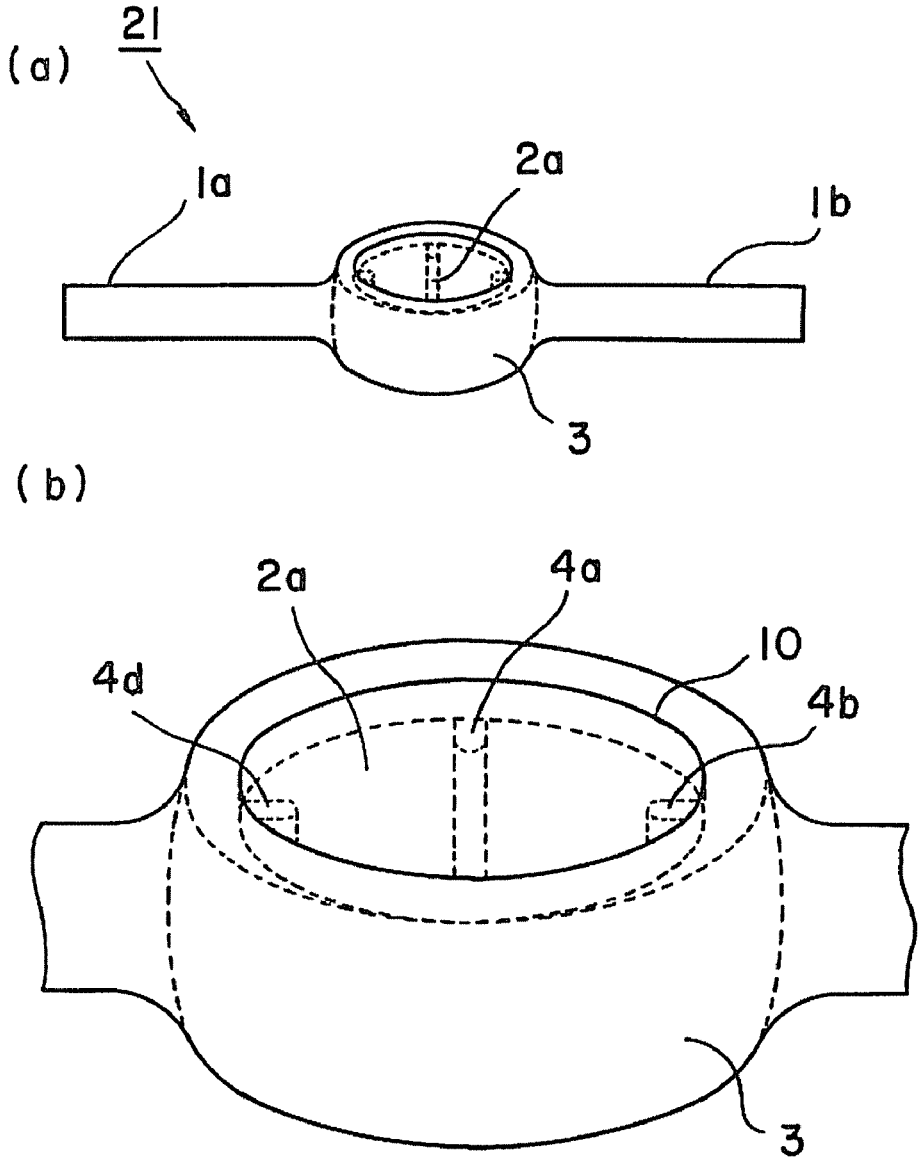
FIGS. 8(*a*) and 8(*b*) illustrate the structure 21, wherein FIG. 8(*a*) is a perspective view thereof, and FIG. 8(*b*) is an enlarged view of a cylindrical end portion in FIG. 8(*a*) for illustrating a claw-shaped stepped portion for positioning a transparent single-crystal alumina disk.

In the embodiment shown in FIG. 8, the composite luminous vessel container structure 21 comprises a polycrystalline alumina luminous vessel member 3 having a cylindrical shape, and a total of two hollow capillaries 1*a* and 1*b* composed of polycrystalline alumina. Each capillary is disposed axially symmetrically outside the side circumferential surface of the cylinder so that the central axis thereof passes through the virtual center of gravity of the cylinder. Single-crystal transparent alumina disks 2*a* and 2*b* are each fitted to both opening parts of the cylinder by use of positioning stepped portions 4*a* to 4*d*. The positioning stepped portion 4*d* is shielded by the cylindrical polycrystalline alumina luminous vessel member 3 in FIG. 8.

Figure 9:
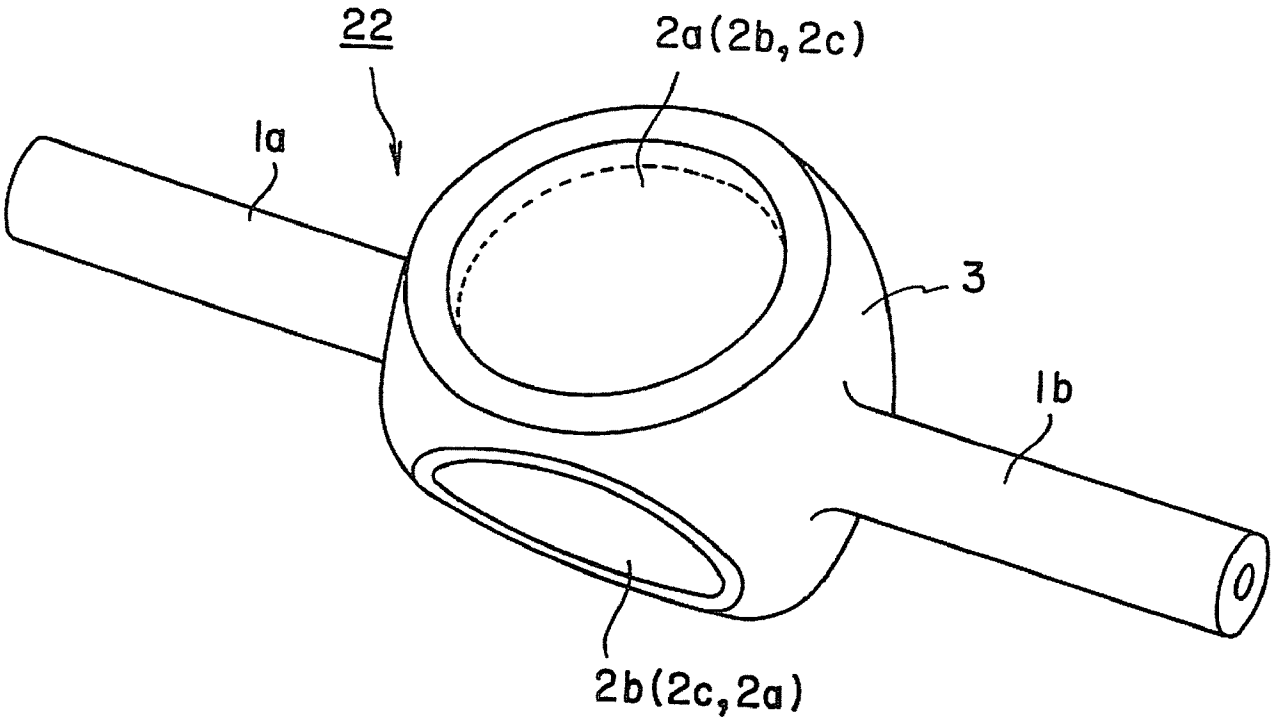
FIG. 9 is a perspective view of a structure 22.

In the embodiment shown in FIG. 9, a composite luminous vessel container structure 22 comprises a polycrystalline alumina luminous vessel member 3 having basically a regular triangle pole shape, and a total of two hollow capillaries 1*a* and 1*b* similarly composed of polycrystalline alumina. Each capillary being disposed axially symmetrically on both end surfaces of the regular triangle pole so that the central axis thereof passes through the virtual center of gravity of the regular triangle pole. A total of three single-crystal transparent alumina disks 2*a*, 2*b* and 2*c* are each fitted to a circular opening part provided on each side surface of the triangle pole. The side circumferential surface of each single-crystal transparent alumina disk is directly integrated with the inner surface of the circular opening part provided on each side surface of the triangle pole so as to develop airtightness by sintering. The single-crystal transparent alumina disk 2*c* is shielded by the cylindrical polycrystalline alumina luminous vessel member 3 in FIG. 9. When the disks 2*b* and 2*c* are shown in FIG. 9, the disk 2*a* is shielded, and when the disks 2*c* and 2*a* are shown in FIG. 9, the disk 2*b* is shielded.

In FIG. 9, the polycrystalline alumina luminous vessel member 3 is smoothly connected with the capillaries, with angular parts at both ends of the regular triangle pole being rounded so as to be laid along the circular opening parts since they are functionally unnecessary. Side angular parts thereof are also rounded. Although the shape of the triangular pole may be designed so that functions as luminous vessel can be developed, the translucent polycrystalline alumina luminous vessel member 3 is desirably designed to entirely have a uniform thickness as much as possible.

Figure 10:
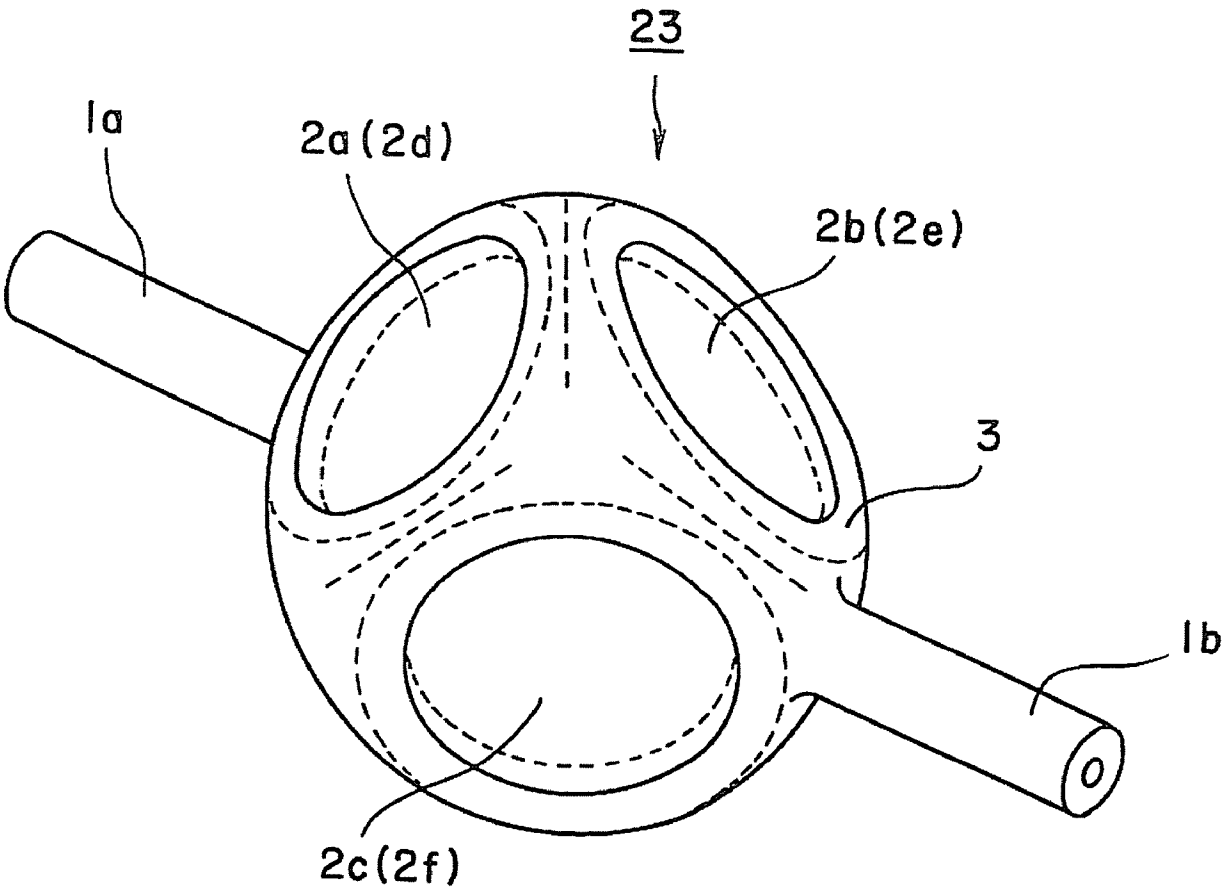
FIG. 10 is a perspective view of a structure 23.

In the embodiment shown in FIG. 10, a composite luminous vessel container structure 23 comprises a polycrystalline alumina luminous vessel member 3 having basically a cubic shape, and a total of two hollow capillaries 1*a* and 1*b* similarly composed of polycrystalline alumina. Each capillary is disposed axially symmetrically at each axially symmetric apex of the cube so that the central axis of the capillary passes through the virtual center of gravity of the cube. A total of six single-crystal transparent alumina disks 2*a*, 2*b*, 2*c*, 2*d*, 2*e* and 2*f* are each fitted to a circular opening part provided on each side surface of the cube. The side circumferential surface of each single-crystal transparent alumina disk is directly integrated with the inner surface of the circular opening part provided on each side surface of the cube so as to develop airtightness by sintering.

In FIG. 10, the disks 2*a*, 2*b* and 2*c* are shown, but the disks 2*d*, 2*e* and 2*f* are shielded by the luminous vessel member. When the disks 2*d*, 2*e* and 2*f* are shown in FIG. 10, the disks 2*a*, 2*b* and 2*c* are shielded by the luminous vessel member.

In FIG. 10, the polycrystalline alumina luminous vessel member 3 is smoothly connected with the capillaries, with an angular portion at each apex of the cube being rounded so as to be laid along the circular opening part since it is functionally unnecessary. Although the apex shape of the cube may be designed so that functions as luminous vessel can be developed, the polycrystalline alumina luminous vessel member 3 is desirably designed to entirely have a uniform thickness as much as possible.

EXAMPLES

Example 1

Figure 11:
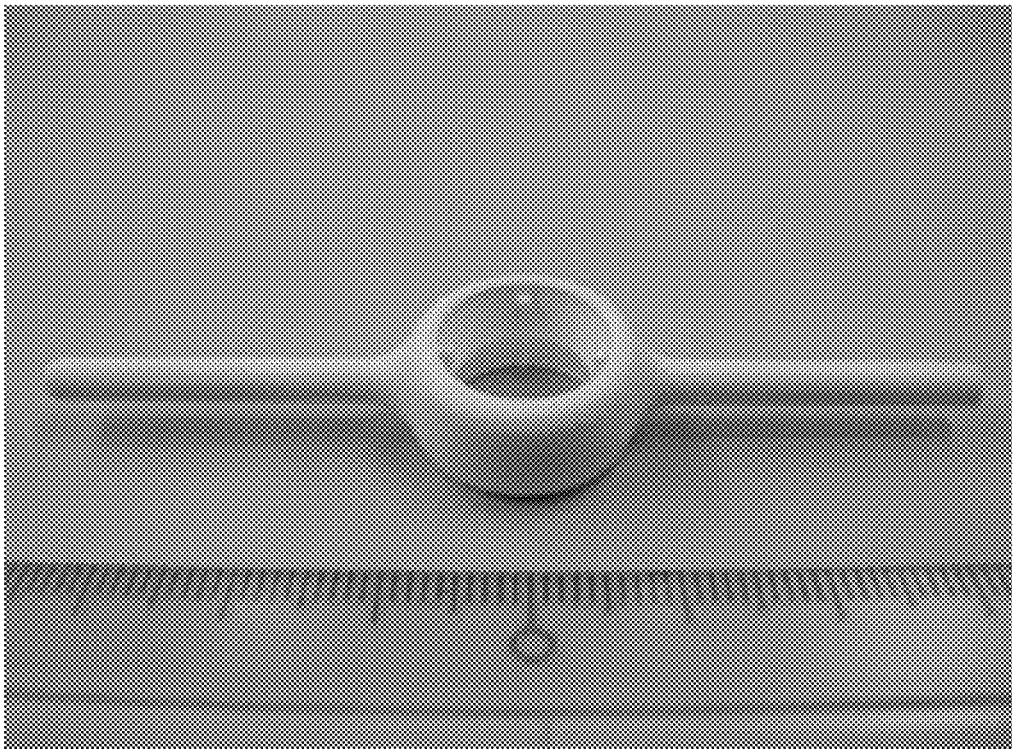
FIG. 11 is a photographic image showing an overall compact of a structure composed of capillary and cylindrical part, produced in an embodiment.
Figure 12:
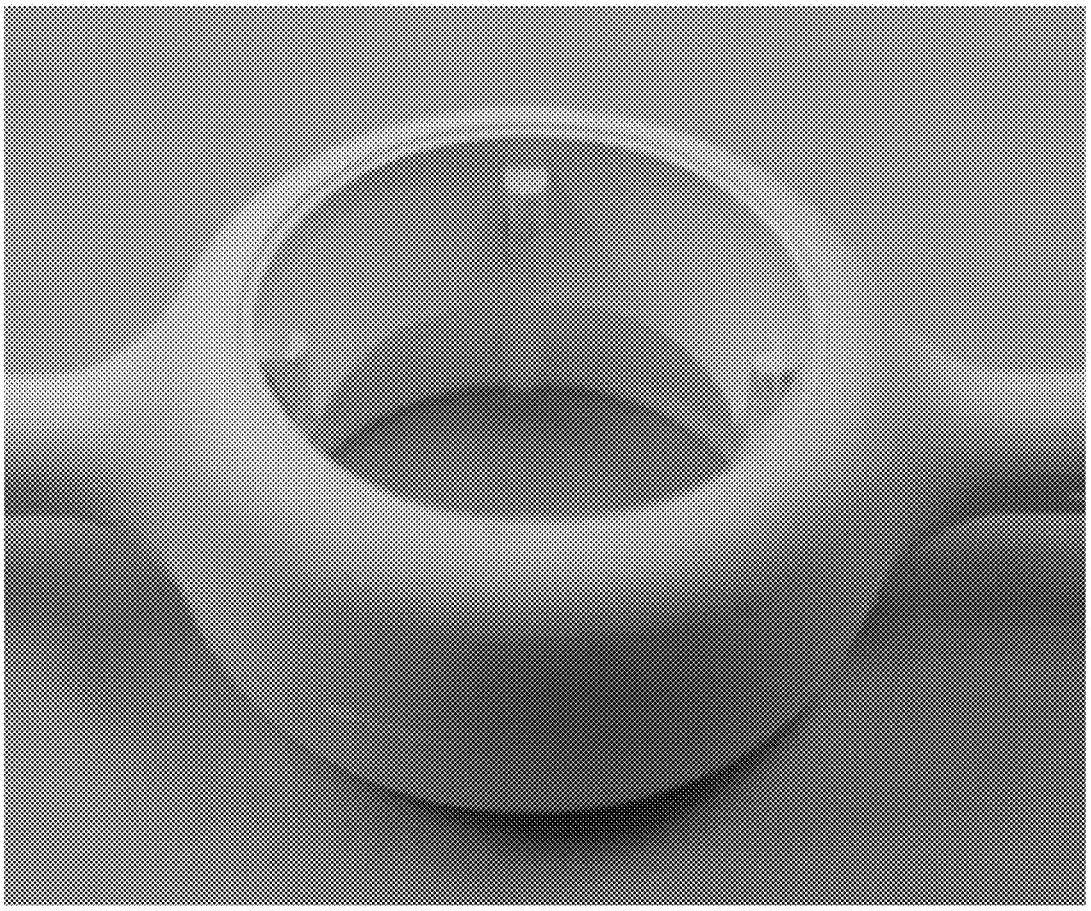
FIG. 12 is a partially enlarged photographic image of the structure composed of capillary and cylindrical part, produced in an embodiment.

A compact composed of capillary and cylindrical part shown in FIGS. 11 and 12 was formed using translucent alumina raw material powder by gel cast molding. The compact includes a cylindrical part 3 having a wall thickness up to 3 mm and capillary parts 1*a* and 1*b* having a wall thickness of 1.1 mm. The cylindrical part has an opening part diameter of 12 mm and a height of 8 mm. Claw-shaped stepped portions 4 for positioning single-crystal alumina disks 2*a* and 2*b* are formed in opening parts of the cylinder. The compact was baked at 1300° C. in the atmosphere to perform removal of binder and calcination. The calcined compact shrinks by about 10% by the baking. A transparent single-crystal alumina disk 10 mm in diameter and 0.8 mm in thickness, polished to a surface roughness Ra of 0.009 μm, was inserted to each opening part or window part of the thus-obtained calcined body. The alumina calcined body was sintered at 1800° C. in a hydrogen atmosphere for 3 hours and shrunk by about 20% by further sintering to join the side circumferential surface of each single-crystal transparent alumina disk to the inner surface of the opening parts of the cylinder. A composite luminous vessel container in which single-crystal transparent alumina disks are thus directly integrated with the translucent polycrystalline alumina member so as to develop airtightness was produced. The resulting composite luminous vessel container showed satisfactory airtightness.

The "airtightness" referred to in the present invention means that leak quantity based on helium leak test is $10^{-8}$ atm.cc/sec or less. The method of the helium leak test is as follows.

Helium gas is sprayed over the outside of a composite luminous vessel container, the inside of which is laid in a vacuum state using capillary opening ends, and the amount of helium gas penetrating into the composite luminous vessel container is measured by a helium leak detector.

A metallic part formed by bonding an electrode part including a coil part formed of tungsten to a lead-in conductor part formed of niobium through molybdenum was inserted to one capillary part of the thus-obtained composite luminous vessel container, and temporarily fixed by a jig so that a joint part of the lead-in conductor with molybdenum was located in the vicinity of the capillary end, with the lead-in conductor being out of the capillary, a ring-like sealing frit material was inserted through the lead-in conductor and placed at the capillary end portion, and this portion was heated to a predetermined temperature and airtightly sealed by melting.

Further, within a glove box of argon atmosphere, mercury and an appropriate amount of an iodide of Na, Tl or Dy as luminous metal were charged into a composite luminous vessel container with the one end portion airtightly sealed through the other unsealed capillary side, and similarly to the above, a metallic part formed by bonding an electrode part including a coil part formed of tungsten to a lead-in conductor part formed of niobium through molybdenum was inserted and temporarily fixed by a jig so that the joint part of the lead-in conductor part with molybdenum was located in the vicinity of the capillary end portion, with the lead-in conductor being out of the capillary, a ring-like sealing frit material was inserted through the lead-in conductor part and placed at the capillary end portion, and this portion was heated to a predetermined temperature and airtightly sealed by melting to thereby complete a composite luminous vessel.

This composite luminous vessel was inserted into a glass outer globe with a lead wire for carrying current being welded to the lead-in conductor of the composite luminous vessel to thereby produce a lamp. The lamp could be lighted as a metal halide high-pressure discharge lamp by supplying current thereto by use of a predetermined ballast power source.

Examples 2 to 5

As shown in Table 1, compacts composed of capillary and cylindrical part in various sizes were formed using translucent alumina raw material powder by gel cast molding. Each compact designed to have, after sintering, a cylindrical part wall thickness of 1 to 3 mm, a capillary part wall thickness of 0.5 to 1.2 mm and a cylinder opening part diameter of 2 to 40 mm was baked at 1300° C. in the atmosphere to perform removal of binder and calcination. The calcined compact shrinks by about 10% by the baking. A transparent single-crystal alumina disk 2 to 40 mm in diameter and 0.5 to 2.5 mm in thickness, polished to a surface roughness Ra of 0.007 to 0.009 μm, was inserted to each opening part or window part of the thus-obtained calcined body. The alumina calcined body was sintered at 1800° C. in a hydrogen atmosphere for 3 hours and shrunk by further sintering to firing-join the side circumferential surface of each single-crystal transparent alumina disk to the inner surface of each opening part of the cylinder, whereby a composite luminous vessel container in which single-crystal transparent alumina disks are directly integrated with the translucent polycrystalline alumina member was produced. The resulting composite luminous vessel container showed, in addition to satisfactory airtightness, sufficient transmittability of visible light with an opening area ratio as large as 13 to 44%, since the opening angle θ of the single-crystal alumina disk was 30 to 56°, and was thus confirmed to have functions as a luminous vessel container for high-luminance discharge lamp.

To one capillary part of each of the thus-obtained composite luminous vessel containers of Examples 2 to 5, a metallic part formed by bonding an electrode part including a coil part formed of tungsten to a lead-in conductor part formed of niobium through molybdenum was inserted and temporarily fixed by a jig so that a joint part of the lead-in conductor with molybdenum was located in the vicinity of the capillary end, with the lead-in conductor being out of the capillary. A ring-like sealing frit material was inserted through the lead-in conductor and placed at the capillary end portion, and this portion was heated to a predetermined temperature and airtightly sealed by melting.

Further, within a glove box of argon atmosphere, mercury and an appropriate amount of an iodide of Na, Tl or Dy as luminous metal were charged into a composite luminous vessel container with the one end portion airtightly sealed through the other unsealed capillary side, and similarly to the above, a metallic part formed by bonding an electrode part including a coil part formed of tungsten to a lead-in conductor part formed of niobium through molybdenum was inserted and temporarily fixed by a tool so that the joint part of the lead-in conductor part with molybdenum was located in the vicinity of the capillary end portion, with the lead-in conductor being out of the capillary. A ring-like sealing frit material was inserted through the lead-in conductor part and placed at the capillary end portion, and this portion was heated to a predetermined temperature and airtightly sealed by melting to thereby complete a composite luminous vessel.

Each of the thus-obtained composite luminous vessels was inserted to a glass outer globe, with a lead wire for carrying current being welded to the lead-in conductor of the composite luminous vessel to thereby produce a lamp. The lamp could be lighted as a metal halide high-pressure discharge lamp by carrying current by use of a predetermined ballast power source.

TABLE 1

| | Ex. 1 | Ex. 2 | Ex. 3 | Ex. 4 | Ex. 5 |
|---|---|---|---|---|---|
| Number of disks | 2 | 2 | 2 | 2 | 2 |
| Surface roughness of Disk (μm) | 0.007 | 0.007 | 0.007 | 0.009 | 0.007 |
| Diameter of disk (mm) | 10 | 8 | 5 | 2 | 40 |
| Thickness of disk (mm) | 0.8 | 0.8 | 0.5 | 0.5 | 2.5 |
| R of corner of side face of disk (mm) | 0.3 | 0.2 | 0.2 | 0.1 | 0.5 |
| Angle of C-axis with respect to the thickness direction of disk (°) | <1 | <1 | <1 | 4 | <1 |
| Presence or absence of alumina single crystal of disk | None | None | one | None | None |
| Angular aperture of disk (°) | 30 | 45 | 56 | 45 | 45 |
| Aperture rate of disk (%) | 13 | 29 | 44 | 29 | 29 |
| Shape of polycrystalline alumina member | Cylindrical | Cylindrical | Cylindrical | Cylindrical | Cylindrical |
| Thickness of polycrystalline alumina member (mm) | 2 | 2 | 1.5 | 1 | 3 |
| Thickness of capillary (mm) | 0.8 | 0.8 | 0.6 | 0.5 | 1.2 |
| Outer diameter of capillary (mm) | 2.4 | 2.4 | 1.8 | 1.5 | 3.6 |
| Average grain size of polycrystalline alumina (μ) | 28 | 28 | 28 | 28 | 25 |
| He leakage (atm · cc/sec) | Below $10^{-8}$ | Below $10^{-8}$ | Below $10^{-8}$ | Below $10^{-8}$ | Below $10^{-8}$ |

Examples 6 to 7, Comparative Examples 1 to 4

As shown in Table 2, each compact composed of a polycrystalline alumina luminous vessel member 3 having a cylindrical, regular triangle pole or cubic shape and capillaries was formed using alumina raw material powder by gel cast molding. Each compact designed to have, after sintering, a wall thickness of the polycrystalline alumina luminous vessel member 3 of 0.8 to 1.5 mm, a capillary part wall thickness of 0.5 to 1.5 mm and an opening part diameter of the polycrystalline alumina luminous vessel member of 1 to 60 mm was baked at 1300° C. in the atmosphere to perform removal of binder and calcination. The calcined compact shrinks by about 10% by the baking. A transparent single-crystal alumina disk 1 to 60 mm in diameter and 0.15 to 5 mm in thickness, polished to a surface roughness Ra of 0.009 to 1 μm, was inserted to each opening part or window part of the thus-obtained calcined body. The alumina calcined body was baked at 1800 to 1860° C. in a hydrogen atmosphere for 3 hours and shrunk by further sintering to firing-join the side circumferential surface of each single-crystal alumina disk to the inner surface of each opening part of the cylinder, whereby a composite luminous vessel container in which single-crystal alumina disks are directly integrated with the polycrystalline alumina member was produced.

TABLE 2

| | Ex. 6 | Ex. 7 | Com. Ex. 1 |
|---|---|---|---|
| Number of disks | 3 | 6 | 2 |
| Surface roughness of Disk (μm) | 0.009 | 0.009 | 1 |
| Diameter of disk (mm) | 5 | 5 | 5 |
| Thickness of disk (mm) | 0.5 | 0.5 | 0.5 |
| R of corner of side face of disk (mm) | 0.2 | 0.2 | Sharp corner |
| Angle of C-axis with respect to the thickness direction of disk (°) | <1 | 4 | 10 |
| Presence or absence of alumina single crystal of disk | None | None | None |
| Angular aperture of disk (°) | 54 | 39 | 14 |
| Aperture rate of disk (%) | 62 | 67 | 3 |
| Shape of polycrystalline alumina member | triangular prism | Cube | Cylindrical |
| Thickness of polycrystalline alumina member (mm) | 1.5 | 1.5 | 1.5 |
| Thickness of capillary (mm) | 0.8 | 0.8 | 0.8 |
| Outer diameter of capillary (mm) | 2.4 | 2.4 | 2.4 |
| Average grain size of polycrystalline alumina (μ) | 25 | 20 | 28 |
| He leakage (atm · cc/sec) | Below $10^{-8}$ | Below $10^{-8}$ | Leakage |
| Remarks | | | Cracks in disk<br>Disk is not transparent |

| | Com. Ex. 2 | Com. Ex. 3 | Com. Ex. 4 |
|---|---|---|---|
| Number of disks | 2 | 2 | 2 |
| Surface roughness of Disk (μm) | 0.009 | 0.009 | 0.009 |
| Diameter of disk (mm) | 1 | 60 | 5 |
| Thickness of disk (mm) | 0.15 | 5 | 0.5 |
| R of corner of side face of disk (mm) | 0.05 | 0.2 | 0.2 |
| Angle of C-axis with respect to the thickness direction of disk (°) | <1 | <1 | <1 |
| Presence or absence of alumina single crystal of disk | None | None | Present |
| Angular aperture of disk (°) | 10 | 45 | 56 |
| Aperture rate of disk (%) | 2 | 29 | 44 |
| Shape of polycrystalline alumina member | Cylindrical | Cylindrical | Cylindrical |
| Thickness of polycrystalline alumina member (mm) | 0.8 | 5 | 1.5 |
| Thickness of capillary (mm) | 0.5 | 1.5 | 0.6 |
| Outer diameter of capillary (mm) | 1.5 | 4.5 | 1.8 |
| Average grain size of polycrystalline alumina (μ) | 28 | 45 | 28 |
| He leakage (atm · cc/sec) | Leakage | leakage | Leakage |
| Remarks | Cracks in disk | Cracks in alumina member | Cracks in disk |

Consequently, in Example 6 where the polycrystalline alumina member has a regular triangle pole shape, which allows fitting of three transparent single-crystal alumina disks, an opening area ratio of 62% could be attained while ensuring airtightness. Further, in Example 7 where the polycrystalline alumina member has a cubic shape, which allows fitting of six transparent single-crystal alumina disks, an opening area ratio of 67% could be attained while ensuring airtightness, and this container was confirmed to have excellent characteristics as a luminous vessel container for high-luminance discharge lamp.

On the other hand, in Comparative Example 1, where side angular parts of the single-crystal alumina disk are finished sharply, sufficient airtightness could not be obtained due to cracking in the single-crystal alumina disk after shrink fitting. In Comparative Example 2, where the single-crystal alumina disk thickness is 0.15 mm being smaller than 0.3 mm, sufficient airtightness could not be obtained due to cracking in the single-crystal alumina disk. In Comparative Example 3, where the diameter of the single-crystal alumina disk is 60 mm (i.e., larger than 50 mm), and the thickness thereof is 5 mm (i.e., larger than 3 mm), cracking was caused on the polycrystalline alumina side. Further, in Comparative Example 3, in which the average grain size of polycrystalline alumina is 45 μm (i.e., larger than 40 μm), airtightness was insufficient due to cracking in the polycrystalline alumna member. In Comparative Example 1, where the surface roughness of single-crystal alumina disk is 1 μm larger than 0.01 μm, the single-crystal alumna disk is not transparent, and cannot directly transmit visible light. In Comparative Examples 1 and 2, where the opening angle θ of single-crystal alumina disk is 14° (i.e., less than 15°), a sufficient light quantity is not ensured due to the opening area ratio of the single-crystal alumina disk being 3% or less. In Comparative Example 1, where the C-axial direction of crystal to the thickness direction of single-crystal alumina disk is shifted by an angle of 10° (i.e., exceeding 5°), cracking was caused in the single-crystal disk due to a stress resulting from thermal expansion anisotropy of the single-crystal alumina disk surface.

In Comparative Example 4 where the single-crystal alumina disk includes sub-grains, cracking was caused in the single-crystal alumina disk after shrink fitting.

The polycrystalline alumina-single-crystal transparent alumina disk composite luminous vessel container of the present invention can be applied to a luminous vessel for high-luminance discharge lamp.

While specific preferred embodiments of the present invention have been shown and described, the present invention is never limited by these specific embodiments, and can be carried out with various modifications and alternations without departing from the scope of the claims.

The invention claimed is:

1. A composite luminous vessel container comprising:

a luminous vessel member comprising polycrystalline alumina and having at least one circular opening part;

at least one discrete transparent disk comprising single-crystal alumina and having two opposed main surfaces; and a pair of hollow capillaries comprising polycrystalline alumina that are fitted to the luminous vessel member;

wherein a side circumferential surface of the at least one discrete transparent disk is directly fitted to and integrated with the at least one circular opening part of the luminous vessel member in an airtight manner.

2. The composite luminous vessel container of claim 1, wherein the at least one circular opening part of the luminous vessel member comprises one circular opening part;

wherein the pair of hollow capillaries are fitted to the luminous vessel member in parallel to the one circular opening part; and wherein each of the hollow capillaries are disposed symmetrically with respect to a virtual axis passing through a center of the one circular opening part in a direction perpendicular to the circular opening part.

3. The composite luminous vessel container of claim 2, wherein an inner surface of the luminous vessel member comprises a curved surface rotationally symmetric around the virtual axis.

4. The composite luminous vessel container of claim 1, wherein the luminous vessel member has a cylindrical shape with two end side surfaces thereof each defining one of the at least one circular opening parts, respectively;

wherein each of the capillaries has a central axis passing through a virtual center of gravity of the luminous vessel member and is provided substantially symmetrically with respect to the virtual center of gravity; and wherein the at least one discrete transparent disk comprises a plurality of discrete transparent disks, and a respective one of the plurality of discrete transparent disks is fitted to a respective one of the circular opening parts.

5. The composite luminous vessel container of claim 1, wherein the luminous vessel member has a hollow triangle pole shape with three side surfaces thereof each defining one of the at least one circular opening parts, respectively;

wherein each of the hollow capillaries has a central axis passing through a virtual center of gravity of the luminous vessel and is provided substantially symmetrically with respect to the virtual center of gravity; and wherein the at least one discrete transparent disk comprises a plurality of discrete transparent disks, and a respective one of the plurality of discrete transparent disks is fitted to a respective one of the circular opening parts.

6. The composite luminous vessel container of claim 1, wherein the luminous vessel member has a hollow cubic shape with six side surfaces thereof each defining one of the at least one circular opening parts, respectively;

wherein each of the hollow capillaries has a central axis passing through a virtual center of gravity of the luminous vessel and is provided substantially symmetrically with respect to the virtual center of gravity; and wherein the at least one transparent disk comprises a plurality of discrete transparent disks, and a respective one of the discrete transparent disks is fitted to a respective one of the circular opening parts.

7. The composite luminous vessel container of claim 1, wherein the luminous vessel member has a wall thickness of 0.3 to 3 mm; and wherein the polycrystalline alumina constituting the luminous vessel member has an average crystal grain size of 40 μm or less.

8. The composite luminous vessel container of claim 1, wherein an angle, defined by an axis extending vertically with respect to the at least one discrete transparent disk through the virtual center of gravity of the luminous vessel and a virtual line connecting the side circumferential surface of the at least one discrete transparent disk with the virtual center of gravity, is within a range of 15 to 60°.

9. The composite luminous vessel container of claim 1, wherein the at least one circular opening part of the luminous vessel member comprises a stepped portion for positioning the at least one discrete transparent disk.

10. The composite luminous vessel container of claim 1, wherein the luminous vessel member and the pair of hollow capillaries are each composed of a translucent polycrystalline alumina sintered body.

11. The composite luminous vessel container of claim 1, wherein the at least one discrete transparent disk has a thickness of 0.3 to 3 mm and a diameter of 2 to 50 mm.

12. The composite luminous vessel container of claim 1, wherein the opposed main surfaces of the at least one discrete transparent disk each have a surface roughness Ra of 0.01 μm or lower.

13. The composite luminous vessel container of claim 1, further comprising an angular part between the opposed main surfaces of the at least one discrete transparent disk and the side circumferential surface of the at least one discrete transparent disk, the angular part being rounded.

14. The composite luminous vessel container of claim 1, wherein a direction of the C-axis of the single-crystal alumina forming the at least one discrete transparent disk defines an angle of ±5° with respect to a thickness direction thereof.

15. The composite luminous vessel container of claim 1, wherein the single-crystal alumina constituting the at least one discrete transparent disk is free from sub-grains.

* * * * *

UNITED STATES PATENT AND TRADEMARK OFFICE

CERTIFICATE OF CORRECTION

PATENT NO. : 8,092,875 B2
APPLICATION NO. : 12/061073
DATED : January 10, 2012
INVENTOR(S) : Keiichiro Watanabe It is certified that error appears in the above-identified patent and that said Letters Patent is hereby corrected as shown below:

Column 7, Line 61 - Column 8, Line 5

Please delete the paragraph in its entirety.

Column 8

*Line 26*: please change "not shown:" to --not shown;--

Signed and Sealed this
Tenth Day of April, 2012

David J. Kappos

David J. Kappos
*Director of the United States Patent and Trademark Office*